United States Patent [19]

Harrison

[11] 4,108,284

[45] Aug. 22, 1978

[54] RAILWAY BRAKE ASSEMBLIES INCLUDING KNOCK-BACK COMPENSATING MEANS

[75] Inventor: Anthony William Harrison, Birmingham, England

[73] Assignee: Girling Limited, Birmingham, England

[21] Appl. No.: 693,798

[22] Filed: Jun. 8, 1976

[30] Foreign Application Priority Data

Jun. 9, 1975 [GB] United Kingdom ..... 24696/75

[51] Int. Cl.[2] ..... B61H 13/20

[52] U.S. Cl. ..... 188/59; 188/71.1; 188/71.3

[58] Field of Search ..... 188/202, 203, 71.8, 188/71.9, 72.8, 72.7, 72.3, 72.4, 58, 59, 196 P, 196 RA, 71.1; 192/94, 111 A

[56] References Cited

U.S. PATENT DOCUMENTS

| | | | |
|---|---|---|---|
| 2,903,098 | 9/1959 | Busch | 188/59 |
| 2,918,981 | 12/1959 | Rupp | 188/59 X |
| 3,269,491 | 8/1966 | Belart et al. | 188/196 P X |
| 3,478,845 | 11/1969 | Kita | 188/73.3 |
| 3,570,631 | 3/1971 | Schaftner | 188/196 P X |
| 3,604,539 | 9/1971 | Goods | 188/59 |
| 3,612,224 | 10/1971 | Walther | 188/71.1 |
| 3,941,220 | 3/1976 | Harrison | 188/71.9 X |

FOREIGN PATENT DOCUMENTS

| | | | |
|---|---|---|---|
| 1,912,285 | 9/1970 | Fed. Rep. of Germany | 188/59 |
| 2,227,390 | 1/1974 | Fed. Rep. of Germany | 188/73.3 |

*Primary Examiner*—George E. A. Halvosa
*Attorney, Agent, or Firm*—Scrivener, Parker, Scrivener & Clarke

[57] ABSTRACT

A brake comprises a rotor which is permitted to float axially and a friction pad which is carried by a support. The support is movable towards and away from a braking surface of the rotor and is urged to a datum position under the action of a return force. A spring or other resilient device is provided which is yieldable when the return force exceeds a predetermined amount to permit movement of the friction member beyond its datum position to compensate for float of the rotor surface, the spring urging the friction pad towards the datum position when the return force is reduced below the predetermined amount.

14 Claims, 6 Drawing Figures

RAILWAY BRAKE ASSEMBLIES INCLUDING KNOCK-BACK COMPENSATING MEANS

This invention relates to brakes and is particularly, but not exclusively, to brake assemblies having friction members which act in different directions on opposed rotor braking surfaces.

The opposed braking surfaces may be on the same rotor, for example as in caliper disc brakes, or on different rotors, for example as in a railway vehicle disc brake which extends between opposed wheels of a wheel and axle set, the friction members acting on the inner surfaces of the wheels or of discs rotatable with the wheels.

It is desirable in such brakes that each friction member be clamped with a substantially equal force to its rotor surface to provide the braking force, and that the friction members are constrained to wear at the same rate. There is a problem in providing such constraint in such brakes in which the "float" of a rotor surface in the direction towards its friction member is greater than the distance which can be allowed between that friction member and its rotor surface as a normal brake running clearance, causing rubbing of the friction member.

The normal brake running clearance, i.e. the clearance between the rotor mean position with no float and the friction member, is normally maintained in the unactuated condition of the brake by providing stops which determine datum positions to which the friction members return, usually under the action of a brake return spring, after each brake application. The stops prevent excessive return travel of each friction member beyond its datum positions.

In accordance with the present invention, there is provided a brake comprising a friction member carried by a support which is movable towards and away from a rotor surface, the support being movable to a datum position under the action of a return force, and resilient means yieldable when said return force exceeds a predetermined amount to permit movement of the friction member beyond its datum position and operative to return the friction member towards the datum position when the return force is reduced below said pretermined amount.

Preferably, said brake according to the invention is one of two such brakes of a brake assembly, the friction members of the brakes acting respectively in different directions on opposed rotor surfaces.

Because no two friction members are normally the same and do not wear at the same rate, the normal running clearance of the slower wearing member is less than that of the faster-wearing member. Thus, in the unactuated condition of the brake assembly, when float of the rotor surfaces occurs the slower-wearing friction member is in contact with its rotor surface for longer periods so that equalisation of the wear of friction members is achieved. The resilient means limits the force which can act between a rotor surface and its friction member during float so that drag on the rotor surface may be negligible, even though the slow equalization wear is occurring.

Preferably, the resilient means is attached to a brake supporting structure.

In each of the embodiments described in more detail below, the return force is normally provided by a brake return spring, the additional force being provided by engagement of the friction member with the rotor surface.

In one embodiment of the invention described in more detail below, the datum positions of the friction members are determined by the position of a rigid actuating linkage connected to the supports, the linkage being mounted on the brake supporting structure through the intermediary of the resilient means.

Some forms of brake in accordance with the invention will now be described, by way of example, with reference to the accompanying drawings, in which.

Figure 1:
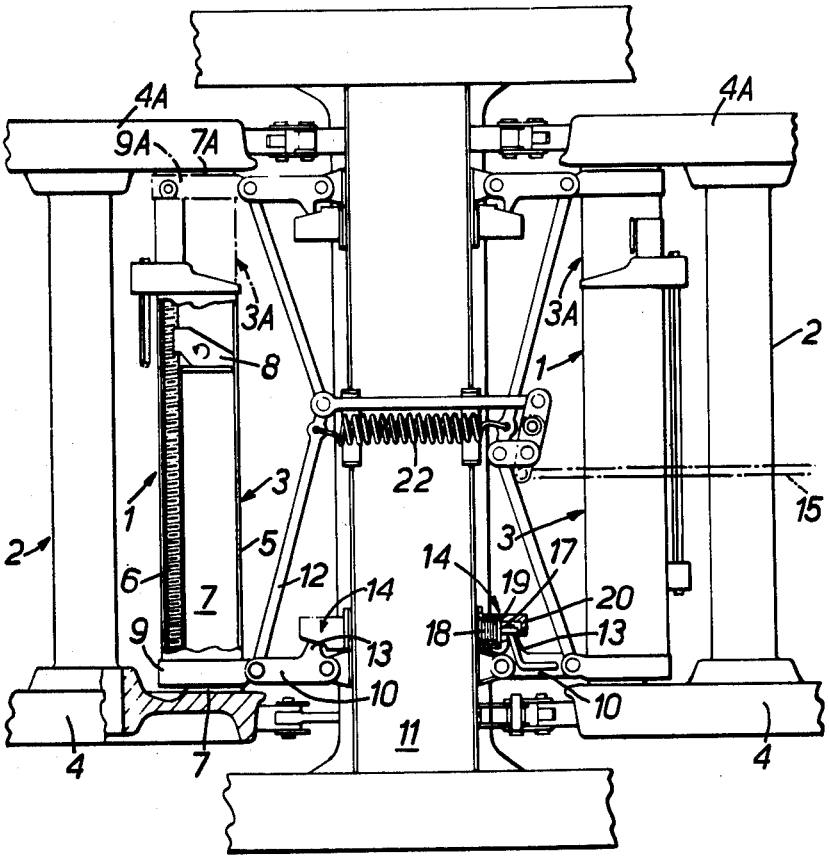
FIG. 1 is a plan view of part of a railway vehicle braking system incorporating one form of brake assembly.

In FIG. 1 there is shown a braking system comprising two substantially identical brake assemblies 1 acting on respective wheel and axle sets 2.

Each brake assembly 1 comprises two brake actuating parts 3, 3A which are themselves identical and which act on respective wheels, 4, 4A of the associated wheel and axle set. Corresponding elements of the brake parts will be allotted the same reference numerals, but with the elements of one of the parts having the suffix A. Only one brake part is described in detail and that comprises a tubular housing 5 within which is rotatably mounted an adjusting screw 6 which lies adjacent an elongate friction pad 7, a nut member 8 engaging the inner end of the friction pad 7 and being screw-threadedly connected to the adjusting screw 6. At the outer end of the tubular housing 5 is an abutment member 9 which is fast with the tubular housing 5 and closely adjacent the braking surface of its associated wheel 4, the abutment 9 being pivotally connected through a link 10 to the bogie frame 11 and to an arm 12 of an actuating linkage. The link 10 has an arm 13 which forms part of the self-centering device 14 to be more fully described below.

The brake part 3 is mounted above the brake part 3A, and all the brake parts are operated through the actuating linkage by an actuating rod 15 which when pulled to the right as seen in FIG. 1 creates compressive forces in the arm 12 to urge the abutment member 9 towards the wheel 4, the braking forces being transmitted through the screw 6 and the nut 8 to the friction pad 7. A brake return spring 22 provides a return force for each of the brake parts of both assemblies to bias them to their illustrated datum positions.

The self-centering device 14 comprises a movable abutment member 17 biased by any suitable resilient means 18 towards a stop 19 and engaging the arm 13 of the link 10. The self-centering device permits movement of the pad to compensate for "float" of the wheel from a mean position. If the float of the wheel 4 is towards the centre of the brake 1, the pad 7 rubs against the wheel until the total return force, i.e. the force between the pad and the rotor together with the return spring force, exceeds a predetermined value at which the resilient means 18 yields. The pad 7 then moves with the wheel against the resilience of the resilient means 18 and when the float ceases to exist the resilient means returns the pad 7 to its normal position.

The resilient means has the effect of equalising wear of the friction pads, 7, 7A acting on the same wheel and axle set. If, say, the pad 7 wears more slowly than the other pad 7A then pad 7 would be closer to the wheel 4. When random float of the wheel about a mean position occurs, pad 7 is contacted by the wheel more often than pad 7A, the force between the pad 7 and the wheel being limited by the resilient means 18. The slower-wearing pad 7 tends to have more material rubbed away in the unactuated condition of the brake, thus achieving equalisation of wear of the pads. In the event of a sudden change in the position of the pad, for example due to a piece of friction material breaking off, the abutment member 9 will not contact the wheel. As a safety feature the arm 13 of the linkage 10 is engageable with a stop 20 at one end of the self-centering device which limits pivoting movement of the arm 10 about its pivot point and thus prevents engagement of the abutment member 9 with the wheel.

Figure 2:
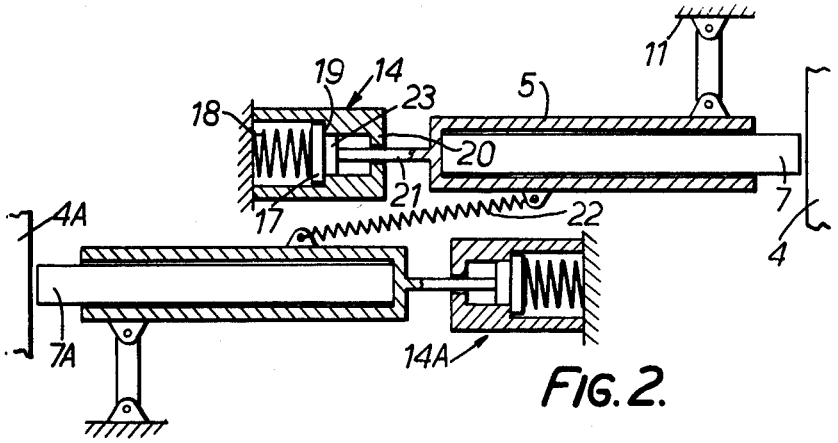
FIG. 2 is a diagrammatic view of another form of brake assembly for a railway vehicle.

FIG. 2 shows an arrangement in which the friction pad 7 is carried in its housing 5 which has a rearwardly extending projection 21 engageable with the movable stop 17 acting on the resilient means 18 of the self-centering device 14, the resilient means being in the form of a coil compression spring. The brake return spring 22 acts to return the housings 5, 5A to their illustrated normal datum positions. The stop 20 is provided at the forward end of the self-centering device 14 and is engageable with an enlarged head 23 of the rearwardly projecting portion 21 of the housing 5 to prevent the forward end of the housing 5 from engaging the wheel 4.

Figure 3:
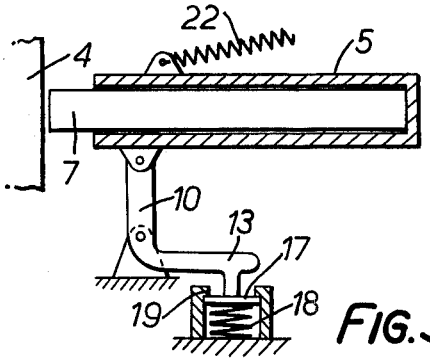
FIG. 3 is a diagrammatic view of part of yet another form of brake assembly for a railway vehicle.

FIG. 3 shows only one part of another form of brake, which is similar to the brake of FIG. 1, in which the resilient means 18 is a coil spring.

Figure 4:
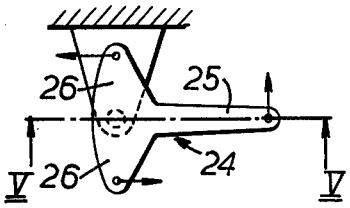
FIG. 4 is a plan view of part of a linkage of yet another form of brake assembly.
Figure 5:
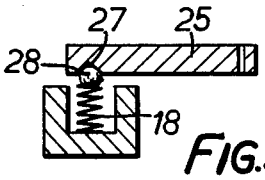
FIG. 5 is a sectional view taken along line V—V of FIG. 4.

In FIG. 4 there is shown a link 24 of an actuating linkage which is in use connected to both housings 5, 5A. The link comprises an arm 25 for connection to an actuating rod and two opposed arms 26 for connection to the respective housings of the brake parts. As can be clearly seen from FIG. 5, the linkage 24 is mounted on the supporting structure through the intermediary of spring 18 which biases a ball 28 into a recess 27.

As previously described the slower wearing pad lies closer to its wheel and is contacted more often during float of the wheel, the resilience of spring 18 limiting the maximum force of pad contact. The slower wearing pad touches the wheel first when an actuating force is applied so that more material tends to be worn off and the pad wear is equalised. When the brake-actuating load is high, equalization of the actuating forces between the pads may cause the ball 28 to ride up the sides of the recess 27 to adjust the brake applying forces to compensate for the differential pad wear.

Figure 6:
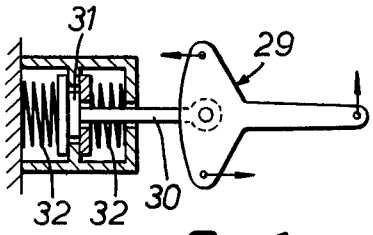
FIG. 6 is a plan view similar to FIG. 4 of a part of a linkage of a further form of brake assembly.

FIG. 6 shows a link 29 generally similar to the link 24 of FIG. 4. In this embodiment the link 29 is pivotally connected to an arm 30 having an enlarged head 31 which is constrained against movement in either brakeapplying direction by respective resilient means 32 in the form of coil springs.

Although particularly described in relation to railway vehicle disc brakes which extend between opposed wheels of a wheel and axle set, the invention is applicable to other forms of brake, for example internal and external drum brakes.

I claim:

1. A brake assembly for a wheel and axle set of a railway vehicle, comprising two rotors having opposed braking surfaces, two braking shoe means, one only associated with each rotor, and a single brake-applying means actuating both braking shoe means, wherein each braking shoe means comprises a friction member engageable with its associated braking surface, a support carrying said friction member and being movable to a datum position under the action of a return force provided by a brake return spring means, a fixed structure, a pivoted link connecting said support to said fixed structure to permit movement of said support towards and away from its associated braking surface in response to operation of said brake-applying means to engage and disengage said friction member with said surface, and resilient means separate from said brake return spring means which biases said pivoted link to a datum position in which said support is held in its said datum position, said resilient means being yieldable when said return force exceeds a predetermined amount to permit movement of said support beyond its datum position in a direction opposite to its brake applying direction and operative to return said support member towards the datum position when the return force is reduced below said predetermined amount, whereby wear of said friction members is equalized.

2. A brake according to claim 1, wherein said resilient means is attached to said brake support structure.

3. A brake according to claim 2, wherein the support has an extension which cooperates with and is biased to the datum position by said resilient means.

4. A brake according to claim 3, wherein said extension has a head portion, and including an abutment member which is engageable by said head portion and is movable away from the datum position in one direction against the bias of said resilient means, and a fixed stop which is engageable by said head portion and prevents said extension moving in the opposite direction.

5. A brake according to claim 3, wherein said extension has a head portion, and including limiting means preventing engagement of said support with said rotor, said means comprising a fixed stop engageable by said head portion of said extension of said support when said support moves a predetermined distance away from its datum position towards said rotor.

6. A brake according to claim 1, wherein said pivoting link comprises a bell-crank lever, one arm of which is connected between said support and said fixed structure and the other arm of which is biased by said resilient means to its datum position.

7. A brake according to claim 6, including an abutment member which is engaged by said other arm of said bell-crank lever, said abutment member being movable in one direction against the bias of said resilient means, and a fixed stop which is engageable by said abutment member to prevent said abutment member moving in the opposite direction away from said datum position.

8. A brake according to claim 1, including limiting means preventing movement of said support into engagement with said rotor, said limiting means comprising a fixed stop.

9. A brake assembly comprising two brakes according to claim 1, wherein said friction members of said brakes act respectively in different directions on said opposed rotor surfaces.

10. A brake assembly comprising two brakes according to claim 1 wherein, said link has three arms, a brake actuating member being connected to one said arm and the other two arms being connected respectively to said supports for said friction members, whereby pivotal movement of said link in response to movement of the actuating member effects movement of the supports to apply said brakes.

11. A brake assembly according to claim 10, wherein said link includes means defining a recess, and including a bearing biased into engagement with said recess by said resilient means, said link being pivotally mounted on said bearing, whereby unequal brake actuating forces can cause the bearing to ride up the sides of said recess and adjust said forces to compensate for differential wear of opposed friction members.

12. A brake assembly according to claim 10, including an extension arm, said link pivoting on one end of said extension arm said resilient means cooperating with the other end of said arm to bias said link to the datum position.

13. A brake assembly according to claim 12, wherein said extension arm has a head portion, and said resilient means comprise two springs which constrain said head portion against movement in either brake-applying direction.

14. A brake assembly according to claim 1 wherein said link and said resilient means are constructed and arranged to permit movement of one support for a friction member beyond its datum position independently of the support for any other friction member.

* * * * *